United States Patent [19]

Willach

[11] 4,220,022

[45] Sep. 2, 1980

[54] ELECTRICALLY CONTROLLED, ELECTRICALLY ENCODED PUSH-BUTTON COMBINATION LOCK

[75] Inventor: Horst Willach, Ruppichteroth, Fed. Rep. of Germany

[73] Assignee: Huwil-Werke GmbH Möbelschloss-und Beschlagfabriken, Fed. Rep. of Germany

[21] Appl. No.: 864,742

[22] Filed: Dec. 27, 1977

[30] Foreign Application Priority Data

Sep. 23, 1977 [CH] Switzerland ..... 11682/77

[51] Int. Cl.[2] ..... E05B 47/00

[52] U.S. Cl. ..... 70/278; 361/172

[58] Field of Search ..... 70/277, 278, 279, 280, 70/264; 361/171, 172; 307/10 AT; 340/147 MD, 164 R

[56] References Cited

U.S. PATENT DOCUMENTS

| | | | |
|---|---|---|---|
| 3,854,310 | 12/1974 | Paull | 70/280 |
| 3,953,769 | 4/1976 | Sopko | 361/172 |
| 4,000,409 | 12/1976 | Graziosi | 361/171 |
| 4,083,424 | 4/1978 | Stemmen | 70/278 |
| 4,093,870 | 6/1978 | Epstein | 70/278 |

*Primary Examiner*—Robert L. Wolfe

*Attorney, Agent, or Firm*—Frishauf, Holtz, Goodman & Woodward

[57] ABSTRACT

A plurality of push-button switches are located on a locking structure which also includes an encoding circuit having a specific code set therein requiring operation of the push-buttons in a predetermined sequence. Operation of the first coded button starts an energy timing circuit which provides electrical energy required to permit the lock to open, the energy timing circuit de-energizing the mechanism after a predetermined time so that the electronic decoding circuit automatically blocks the lock unless the proper code was entered within the predetermined time interval, and the appropriate first push-button, providing for energization of the entire system, was first operated. The timing circuit preferably is a capacitor which is charged upon operation of the first push-button, encoded to be first operated and which, if the proper code is punched, provides energy to a solenoid coil which releases a locking element if the proper code permits discharge of the capacitor through the solenoid.

27 Claims, 5 Drawing Figures

ELECTRICALLY CONTROLLED, ELECTRICALLY ENCODED PUSH-BUTTON COMBINATION LOCK

Cross reference to related application, the disclosure of which is hereby incorporated by reference: U.S Pat. No. 864,743, filed Dec. 27, 1977, Rolf WILLACH, now U.S. Pat. No. 4,149,212.

The present invention relates to an electrically encoded push-button combination lock which can be unlocked only upon operation of push-buttons in a predetermined sequence.

Various types of push-button—selectable locks using electronic coding have been proposed. Push-button coding and encoding itself is well known, see, for example, the well-known push-button telephones.

THE INVENTION

It is an object to provide an electronically encoded lock which is essentially foolproof, provides a high degree of security against decoding by repetitive operation of the push-buttons, while still requiring only a minimum number of buttons, and still permitting use of a large number of coding possibilities.

Briefly, the push buttons are connected to an electrical encoding apparatus which is connected to a timed energy supply circuit providing energy to permit the decoding, and subsequent opening operation of the lock only for a predetermined time period. This circuit may, for example, be a capacitor charged upon operation of the particular push-button coded to be first one and, unless operated, no current is supplied to the encoding circuit enabling possible opening operation of an electromagnet if the proper code has been inserted, upon completion of the encoding.

Thus, single or multiple operation of any one push-button having a specific numerical value or position assigned thereto causes a suitable pulse or switching step to occur. Upon operation of that particular push-button which is assigned the first operating step, a capacitor is charged which supplies the necessary electrical energy for the opening procedure. Consequently, also, operation of the push-buttons becomes meaningless after a short period of time, determined by the discharge time of the capacitor, so that the electronic system automatically locks the lock and any additional or previously incorrect operation of the push-buttons does not influence lock operation.

Rather than using a capacitor, some other time circuits to provide or control energy to the opening element—typically an electromagnet—may be used, such as a timing circuit which, after a predetermined time, de-energizes the lock automatically, the locking pin or bolt being held in locked position by a spring. An electronically or electrically switch electromechanical transducer, for example a solenoid with a pull-in magnetic core, preferably is used to release a mechanical lock or, under spring loading, to effect mechanical locking.

The operating push-buttons have associated therewith a certain digital position or value within the combination. This, and using multiple sequential operations of one push-button, permits a large number of coding steps to be carried out while still using only a small number of push-buttons. The particular coding thus can be sophisticated with a large number of different codes associated with any one lock. By use of a timing circuit within the current supply to the code control circuit, which is enabled only upon operation of the properly assigned push-button which is to be operated first, it is possible to limit current supply for a sharply limited time of the encoding and subsequent opening step, e.g., for only several seconds. During all other times, the lock is deenergized. This permits operation of the locks without connection to electrical power networks and provide, instead, locks which are compact and independent of external power sources, powered only by a small battery included in the lock structure itself. Limiting power supply of the battery only to the time required to open the lock permits not only saving of electrical energy—and hence use of a small, longlife battery—but additionally provides for safety of unintended opening of the lock since any operation of the push-buttons subsequent to the first operation, after the time lapse, has no influence on the lock which remains in locked condition, automatically. Further, incorrect operation of the push-buttons by an unauthorized person, ignorant of the code, requires that the first push-button operation be of that button which energizes the system, or any push-button operation becomes meaningless. This substantially increases the security of the lock with respect to unauthorized operation.

The coding circuit itself can be made in the form of integrated circuits, or as separate discrete elements and, preferably, is so arranged that a plug board is accessible at the interior of the lock, arranged in modular form, so that a specific code can be changed by resetting plugs, or replacement of elements, for example of precoded memory sections. Alternatively, programmable read-only memories (PROM) can be used in the electronic decoding system the change the combination of a specific lock, if it is not desired to do so by means of patch connections in a plug or path board.

The structural arrangement of the combination lock can be located within a single lock housing which has, exposed, the buttons for manual operation of the lock together with a push-button, latch or doorknob to open the lock manually, which is disabled from operation unless the proper push-buttons have previously been operated, in the predetermined sequence, which may include multiple operation of any one push-button.

The lock, in one form, includes an electromechanically controlled element which is controlled by an electronic controllable coding circuit, the electromechanical element opening a mechanical locking arrangement. The mechanical element, typically, is a solenoid coil, in which a locking bolt enters, e.g., a hollow coil, the locking bolt cooperating with a mechanical locking element. Upon energization of the solenoid, the bolt is pulled from an opening in the locking element, permitting manual operation thereof, for example opening of a door. Preferably, the locking bolt is returned to locked, closed condition after the lock has been manually operated, or upon closing of the door, by providing a slide path for the door locking bolt which engages in an opening of the locking element. The solenoid at the same time can be positively severed from the electrical circuit or, as would usually be the case, the circuit has dissipated the energy required to open the lock already, so that the solenoid is effectively de-energized and further operation of the lock is prevented unless the code is newly entered into the lock. Of course, a manual override to hold the locks in its unlocked condition can be provided. If the magnet is positively de-energized after opening, which can readily be obtained by a further simple circuit, a subsequent opening of the door without re-selecting and decoding the lock would not be possible, even if the time has not yet elapsed which has been permitted by the timing circuit during which energy is supplied to permit opening of the lock.

The lock can be readily arranged to permit closing of small structures, such as file cabinets, storage lockers, file drawers, desk drawers, and the like. Additionally, it is readily adaptable to permit an override with respect to continued opening operation so that, during predetermined times, for example during regular office or business hours, the lock can be opened without repeated operation of the push-buttons without, however, interfering with safety against unauthorized opening at other times.

The coding circuit itself may be of any desired form of push-button operated coding arrangement. In a preferred form, and particularly applicable to the present invention, a coding circuit is used which is described in copending application Ser. No. 864,743, filed Dec. 27, 1977, Rolf Willach, now U.S. Pat. No. 4,149,212 the disclosure of which is hereby incorporated by reference.

Drawings, illustrating an example:

Figure 1:
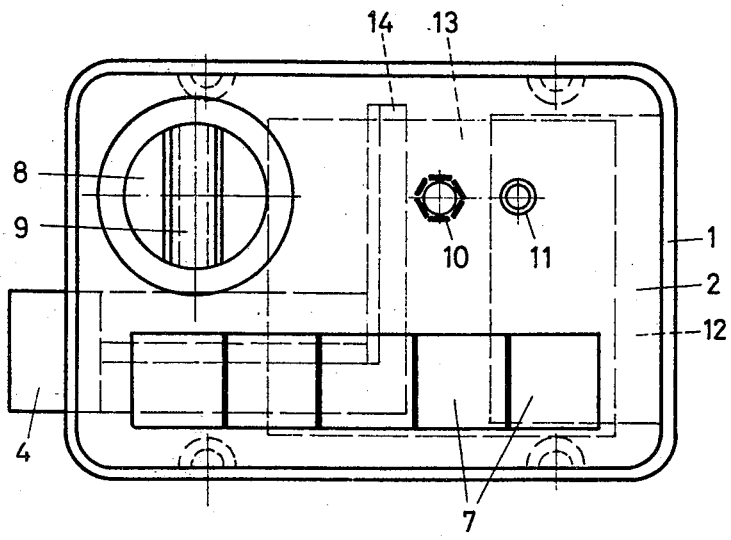
FIG. 1 is a front view of the push-button combination lock.

A box-shaped housing 1 (FIGS. 1, 2) has a front plate 2, a back plate 3 and encloses a movable locking bolt 4. The lock can be installed in a wooden door 5 (FIG. 2), for example the door of an article of furniture, by locating the lock in an opening therein. The front plate 2 will then fit against the front side of the door 5. The lock is secured to the door by holding screws 6.

Five push-buttons 7, for example, and preferably of essentially square shape, are located on the front plate 2. These push-buttons 7 must be pressed in a proper coded sequence for a proper coded number of selection operations in order to open the lock. A knob 8 is located, recessed, within the front plate and in the interior of the housing 1. The knob 8 has a handle portion 9 which is so shaped that it can be gripped by the fingers of a user and can be rotated in order to move the bolt 4 when the lock is in unlocked condition, and additionally to permit longitudinal pulling force to be applied thereto to open the door of the item of furniture after unlocking, that is, after rotation thereof. The opening movement would be downwardly with respect to FIG. 2.

Figure 2:
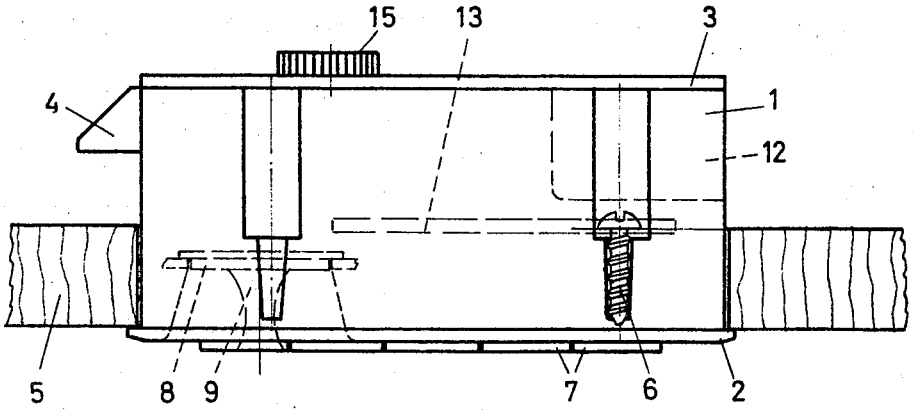
FIG. 2 is a top view of the lock, installed in a wooden door which is shown in section.
Figure 3:
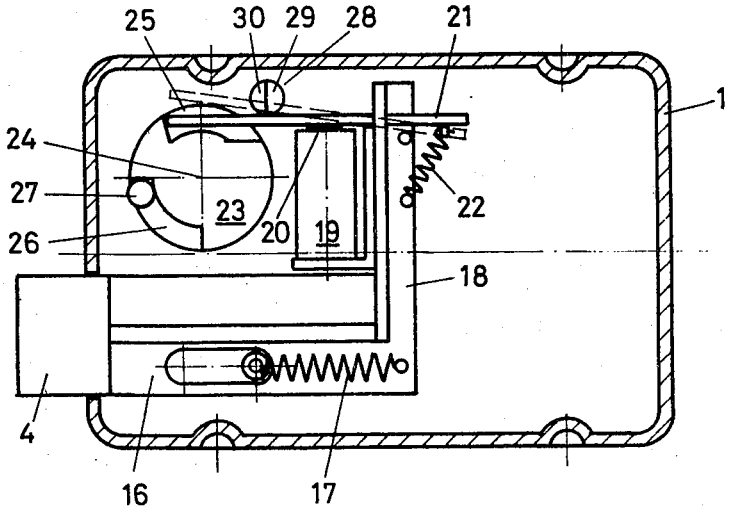
FIG. 3 is a front sectional view of the lock, with the front plate of the lock removed.

The front plate 2 additionally has two contacts 10, 11 (FIG. 1) which are shaped as button contacts to permit connection of a suitable commercial battery, for example a 9 V battery customary with transistorized radios and the like. This external connection is provided as a safety and emergency power supply if, for example, a battery 12 located within the housing 2, should have become exhausted. Battery 12 is shown in broken lines in FIGS. 1 and 2. It is used to supply electrical power to an electronic coding circuit, carried on a printed circuit board 13. Additionally, it supplies power to an electrically operated locking device 14 (FIGS. 1, 3).

The back side 3 of the lock includes a button 15 which can be used to override the lock, that is, to permit placing the locking bolt 4 in a continuously unbarred condition, so that the button 8 can be operated without first operating the coded buttons 7. This position is useful, for example, if the door is to be repeatedly opened during a certain working period (for example a secured file), for instance during the day in a "day" position, to be locked, however, during the night.

The locking bolt 4 (FIG. 3) is guided in a slide path or slide rail 16 and is pulled into locked, projecting position by a spring 17 located within the housing 1. The slide rail 16 has an arm 18 secured thereto, projecting at right angles upwardly. The upwardly projecting arm cooperates with a relay which has a relay coil 19 and a core 20 which is in magnetically coupled connection with an armature 21. The relay coil 19 and the core 20 are attached to the arm 18. The armature 21 is normally held in the broken-line rest position under force of the spring 22. Energization of the coil 19 of the relay moves the armature into the full-line position of FIG. 3.

A cam disk 23 is associated with the armature 21. The axis 24 of the cam disk 23 also forms the shaft of the handle 8 (FIGS. 1, 2). The cam disk 23 is formed with a first recess or groove 25 to receive the armature 21, and with a second groove 26 cooperating with a stop pin 27 secured to the housing 1.

A cylindrical pin 28 (FIG. 3) is secured to the turn button 15 (FIG. 2) located at the inside or rear side of the housing 1. The cylindrical pin 28 is half cut away within the region of the armature 21 so as to be only semicylindrical by being formed with a semicylindrical notch 30, leaving a semicircular cam projection 29.

FIG. 3 illustrates the lock in the "day" position, that is, the internal or override button 15 has been rotated to move the cylindrical pin 28 in a direction in which the semicircular region 29 presses the armature 21 downwardly against the core 20 of the relay coil 19. Upon rotation of the handle 8 (FIGS. 1, 2) about the axis 24 (FIG. 3) in clockwise direction, that is, to open the lock, the notch 25 of the cam disk 23 engages the armature 21 and pushes the armature 21, and with it the coil 19 attached thereto, to the right so that the slide track 16, and hence bolt 4, is moved to the right counter the force of spring 17. This then permits opening of the door 5 (FIG. 2) upon pulling on handle 8.

If the override or day button 15 is rotated that the semicircular opening 30 is opposite the armature 21, then armature 21 will be pulled by spring 22 into the broken-line position (FIG. 3), extending radially outside of the notch 25 of cam disk 23. Cam disk 23, and with it the rotary handle 8, can be rotated freely without operating the bolt 4. The extent of free rotation is limited by the length of the notch 26 which is engaged by the stop pin 27.

OPERATION:

To open the lock, and hence open the door 5, it is necessary to operate the push-button 7 (FIGS. 1, 2) in accordance with a predetermined coding. If this is done properly, that is, in accordance with the code, the coil 19 of the magnet is energized by receiving a current pulse, limited in time. This current pulse pulls in the armature 21. If the cam disk 23 is located in the position shown in FIG. 3, that is, is rotated counter-clockwise, armature 21 will engage the notch 25 so that, upon rotation of the handle 8 (FIGS. 1, 2), bolt 4 is moved towards the right. The short period of time of engagement is sufficient to permit frictional holding of the armature 21 in the notch 25 and rotation of the handle 8.

After termination of the current pulse, the armature 21 releases, particularly upon release of engagement of the knob 8 which causes frictional engagement of the armature 21 with the notch 25; armature 21 will thus again release upwardly into the position shown in broken lines in FIG. 3 so that, after subsequent closing of the door, renewed opening is possible only if the coded combination is again inserted into the lock by operating push-button 7. If, for example, upon termination of operation of the pushbuttons, cam disk 23 is not shown in the terminal position, rotated in counter-clockwise direction, the core 20 cannot pull-in armature 21 into the notch 25 of the cam disk 23 which disables operation of the bolt 4. This is a further safety and security measure against unauthorized operation of the lock.

Figure 4:
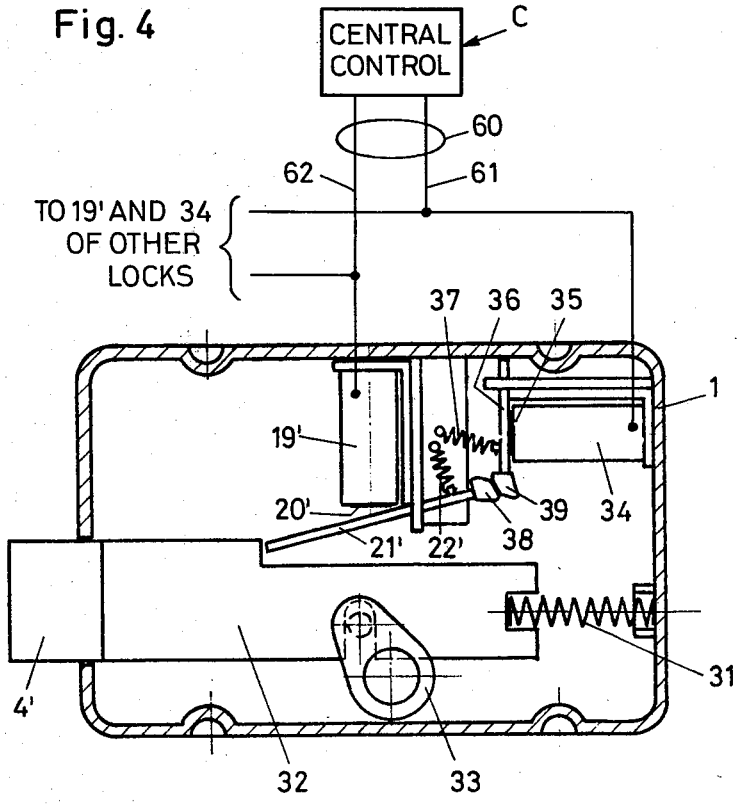
FIG. 4 is a front sectional view similar to FIG. 3, illustrating another embodiment of the invention.

Embodiment of FIG. 4: The armature 21' of the relay coil 19', which is fixedly located within the housing 1, functions as a locking element which acts directly on the slider bolt track 32 secured to the bolt 4', and pressed outwardly by a spring 31. This is in contrast to the embodiment of FIG. 3 in which the armature 21 acts as a coupling element interposed between the rotary handle 8 and the bolt 4 upon energization of the core 20, and in which manually operable override pin 28 is provided. In the embodiment of FIG. 4, the bolt slider 32 is directly unlocked upon energization of the coil 19', and hence magnetization of core 20' and pull-in of armature 21'. An operating knob similar to knob 8—not shown in FIG. 4—can then be used to slide the bolt 4' to the right, the operating knob being attached, for example, to a shaft connected to operating link 33. Armature spring 22' normally retains the armature in the locked position as shown in FIG. 4.

The embodiment of FIG. 4 permits electronic override during a "day" position and automatic locking for a "night" position. To permit free movement of the bolt upon operation of the bolt knob through link 33, a second relay having a coil 34, a core 35 and an armature 36 is provided. Spring 37 acts as a bias return spring for the armature 36, tending to pull it towards the left (FIG. 4). The ends of the two armatures 21, 36 have a slide button 38, 39, respectively, applied thereto which, as shown, are in engagement in rest or normal position.

OPERATION:

In the position shown in FIG. 4, the armature 21' of the first relay locks the slider track 32 and presses with its ends piece 38 against the end piece 39 of the second relay to engage end piece 39, and hence armature 36 with its core 35. After proper operation of the push-buttons 7, in accordance with their code, coil 19' of the first relay receives a current pulse, limited in time, causing armature 21' to pull in, so that the bolt rail 32 and hence bolt 4' will be unlocked, permitting operation of bolt 4' into locked position upon operation of the knob which moves link 33. As the armature 21' has pulled in due to energization of coil 19', the armature 36 of the second relay—which is deenergized—is pulled by its spring 37 in its rest or unlatched position and will retain the armature 21' in pulled-in condition, even after the current flow through coil 19' has ceased. The lock can be operated as often as required, without further encoding of the lock code, by mere operation of the link 33 by a suitable operating knob. Upon energization of the second relay, however, even only for a short current pulse, the armature 36 is pulled to the position shown in FIG. 4, which permits armature 21' of the first relay to snap into the position shown in FIG. 4 and lock the bolt 4'; if the lock should have been in unlocked state before, the armature 21' will merely slide at the upper face of the bolt 4', or the slide rail attached thereto, and snap into the notch as shown in FIG. 4 upon the next locking operation of the lock.

The embodiment of FIG. 4 is particularly suitable for a plurality of locking installations, for example a plurality of office files, furniture elements, or the like, in which the coils 34 of the second relay are connected to be energized from a central control position C. Upon beginning of the working day, all locks must be opened individually by providing the proper code associated with the individual lock to the various push-buttons 7 (FIGS. 1, 2) and will then remain in the "day" position. At the end of the working day, opening of the locks is then prevented without knowledge of the specific code assigned to a lock, by energizing line 61, from central source C by applying to the coils 34 a short current pulse. It is to be noted that neither the "day" position nor the locked position require any supply current to maintain the locks in those conditions. Thus, failure of current supply cannot result in opening of the locks and no energy is consumed when the locks are closed. The only current consumption occurs for the short period of time to open the locks and, in the embodiment of FIG. 4, for common "night" locking of all the locks.

The relay of FIG. 3, and the first relay of FIG. 4, can, of course, also be connected to an additional circuit 62 to be controlled from the central station C, for example to unlock all the locks and bring them in the "day" position from a central point, operation of the locks at other times, however, requiring knowledge of the individual code associated with the individual locks. Lines 61 and 62 can be cabled together in cable 60.

Various changes and modifications may be made; for example, the "day" position of FIG. 3, rather than being manually operated, can also be electrically controlled. Thus, rotation of the pin 28 can be effected by a rotary solenoid, for example, controlled by line 61 from a central station C, or individually. Electrical control of the relay coils 19 (FIG. 3) or 19' (FIG. 4) is effected in accordance with the circuit arrangement of FIG. 5.

Figure 5:
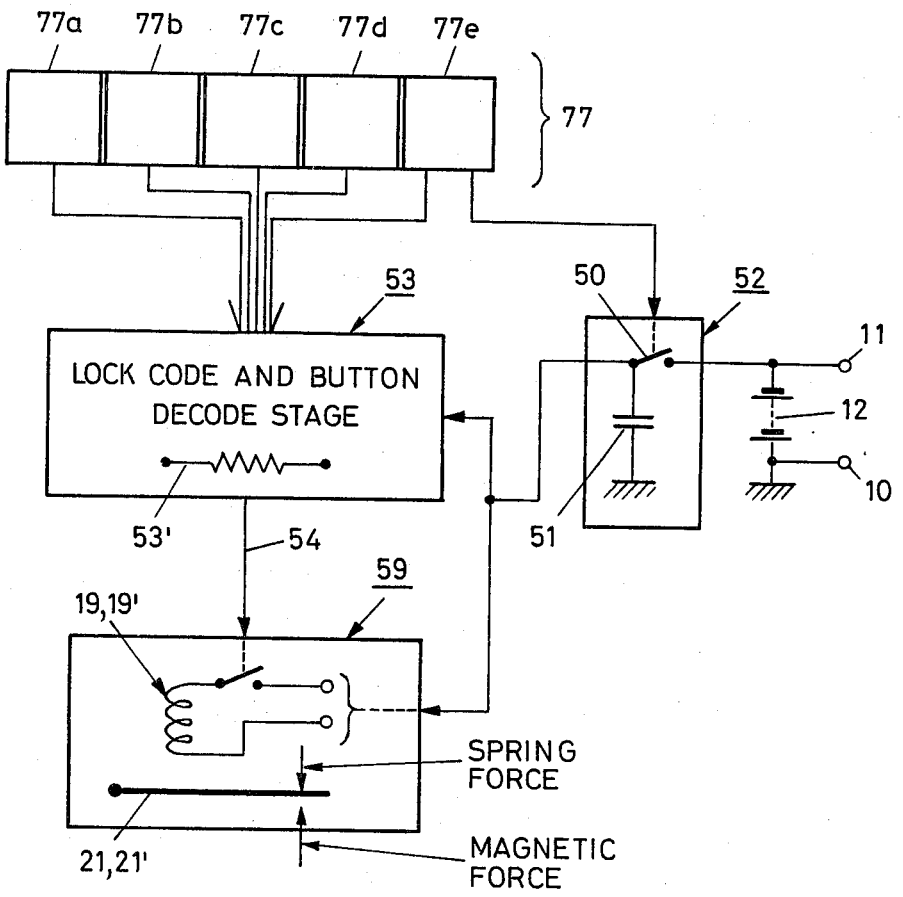
FIG. 5 is a schematic electrical diagram of the lock and the electrical circuitry therefor.

An array of push-buttons 77, having individual push-buttons *77a, 77b, 77c, 77d, 77e,* is connected to a lock code and button decode stage 53. Stage 53 includes the code for the specific lock and decodes the operation of specific buttons of the array 77 in accordance with the code, and provides an output signal on line 54 to the operating magnet unit 59 which includes the solenoid coil 19, or 19', respectively. Let it be assumed that the last button, *77e,* must be operated first. Button *77e,* besides being connected to the lock code and button decode stage 53 is additionally connected to a switch 50 which closes a circuit to a charge capacitor 51. Only momentary operation of the button *77e* is necessary, the switch then opening again, so that a certain amount of electrical energy from battery 12 is stored in capacitor 51. Capacitor 51 provides electrical energy to the lock code and button decode stage which, as far as capacitor 51 is concerned, presents a load thereto, as schematically shown by the resistor symbol 53' within stage 53. Sufficient energy is additionally available from the capacitor 51 to energize the relay coil of the relay stage 59 to pull in the armature thereof counter the spring force. Both the magnetic force by the core, when the coil is energized, as well as the spring force acting on the armature, are shown in FIG. 5, symbolically, as force arrows. Switch 50 and capacitor 51, thus, form a limited or timed energy supply circuit in which the duration and amount of energy being supplied is limited. If the code entered into the array 77 of the buttons is incorrect, the charge from capacitor 51 will still leak off through the resistance components within the stage 53, as schematically indicated by the load 53', even if no energy is consumed in pulling in the armature of the relay within stage 59 counter the spring force. The energy leakage from capacitor 51 can be along an exponential decay curve, that is, providing most of the energy within a short period of time, but then decreasing rapidly. This short period of time may be a few seconds, but long enough to permit encoding of the proper code into the pushbuttons by an authorized person who knows the code and can thus operate the buttons rapidly, but disables both the lock code and button decode stage as well as power supply to pull in the magnet of stage 59 if this short time is exceeded. The lock code and button decode stage is so arranged that incorrect encoding, for example operation of button 77*e* as the second button, while providing power for subsequent electronic operation of the button decode stage, will not result in a release signal from the stage 53 through line 54 to permit energization of the coil within stage 59 from the charge on capacitor 51 which will dissipate shortly thereafter through the load elements within the stage 53. A suitable circuit for stage 53 is disclosed in the aforementioned cross-referenced application.

Various changes and modifications may be made, and features described in connection with any one embodiment may be used with any of the others, within the scope of the inventive concept.

I claim:

1. Electrically controlled, electrically encoded push-button combination lock comprising a locking means (4) normally in locked condition;

a plurality of push-button switches (7, 77);

an encoding circuit (13, 53) connected to the push-button switches providing an output permitting unlocking of the locking means if, and only if, the sequence of operation of the plurality of pushbutton switches conforms to a code contained in the encoding circuit;

and comprising the combination of a source of operating power (12);

a timing circuit (50, 51, 53') connected to a selected one of the push-button switches (77*e*) which, in accordance with the code, is the first one to be operated, said timing circuit also being connected to said source of operating power (12) and being energized thereby upon operation of said selected one of the push-button switches to start a timing interval and to remain energized during said timing interval only;

said timing circuit further controlling energization and de-energization of the encoding circuit (13, 53) by, and from said source of operating power to permit affecting the encoding circuit on subsequent operation of the push-button switches, said timing circuit, after elapse of said timing interval, deenergizing said encoding circuit to leave said lock in locked condition.

2. Lock according to claim 1, further including electromagnetic operating means (19, 19';59) connected to said timing circuit (50, 51, 53') and energizable by said timing circuit during said timing interval only and if the code associated with the lock has been entered into the encoding circuit (13, 53).

3. Lock according to claim 1, wherein said timing circuit comprises a capacitor (51) connectable by said selected push-button switch (77e) to said source of operating power (12) to be charged thereby upon momentary operation of said selected one of said push-button switches, the charge on the capacitor providing the energy to enable operation of said encoding circuit.

4. Lock according to claim 2, wherein said timing circuit comprises a capacitor (51) connectable by said selected push-button switch (77e) to said source of operating power (12) to be charged thereby upon momentary operation of said selected one of said push-button switches, the charge on the capacitor providing the energy to affect said encoding circuit, and providing energy to said electromagnetic operating means (19, 19'; 59) if the code entered into the encoding circuit (13, 53) is the code associated with the specific lock.

5. Lock according to claim 1, further including a housing (1), said housing providing a support for said source of operating power (12), the plurality of push-button switches (7, 77) and the encoding circuit (13, 53);

electromagnetic operating means (19, 19'; 59) controlled by said encoding circuit located within the housing;

and manual operating means (8, 15) engageable with said locking means (4) secured to said housing.

6. Lock according to claim 1, further including electromagnetic operating means (19, 19'; 59) controlled by said encoding circuit (13, 53) and permitting operation of said lock to unlocked position upon proper coded operation of said plurality of push-button switches in accordance with the code, said electromagnetic operating means being energizable from energy supplied by said source of operating power (12) during the timing interval defined by said timing circuit (50, 51, 53').

7. Lock according to claim 6, wherein said electromagnetic operating means includes a solenoid (19, 19'), an armature in electromagnetic coupled relation with said solenoid;

means (23, 32) interlocking operation of said armature of said solenoid and said locking means (4) to prevent operation of said locking means;

and override means (15, 28, 29, 30; 34–39) engageable with the armature (21) and moving the armature in magnetically attracted position independently of energization of said solenoid.

8. Lock according to claim 7, further including a manual operating knob (8) engageable with said locking means (4), the armature (21) forming a coupling element between said locking means and said knob.

9. Lock according to claim 8, wherein said solenoid (19) is movably mounted on the locking means (4);

said means to prevent operation of the locking means includes a cam disk (23), the armature being engageable with a portion of the cam disk if (a) the solenoid is energized, or (b) said override means is operated.

10. Lock according to claim 7, wherein the locking means (4') is formed with a notch, the armature (21') being engageable in the notch and locking said locking means unless the armature is attracted by the solenoid (19').

11. Lock according to claim 7, wherein said override means includes a rotary element (28) formed with a camming surface (29, 30) selectively engageable with, or releasing said armature from a position simulating magnetic attraction of said armature by the solenoid (19).

12. Lock according to claim 7, wherein said override means comprises a second electromagnetic means (34-37) including a second solenoid (34) and a second armature (36), the second armature being positioned to be in operative engagement with the armature (21') of said operating electromagnetic means (19'-21').

13. Lock according to claim 12, wherein the second electromagnetic means includes a return spring (37) acting on the second armature (36), the second armature (36), when de-energized, being positioned with respect to the armature (21') of said electromagnetic operating means (19'-21') to hold said operating armature (21') in the position which the armature (21') has when its associated solenoid (19') is energized and said operating armature (21'), when energized, then permitting movement of the second armature (36) to its rest, de-energized position, the operating armature (21') permitting selective control of the locking means (4') by a manual operating knob if said armature (21') is (a) attracted due to energization of its solenoid (19') upon proper operation of the encoding push-button switches (7, 77) within said timing interval, and (b) (i) if said second magnet is de-energized, said operating armature (21') being retained in the position after elapse of the timing interval but (ii) upon energization of the second solenoid (34) of the second electromagnetic means (34-37), said operating armature (21') reverting to its rest position, thus engaging the locking means and preventing movement thereof to unlocked position unless the encoding circuit (13, 53) is properly operated to conform to the code contained therein.

14. Locking system including a plurality of locks, each according to claim 12, further including a central station (C) and common connection means (60, 61, 62) to at least one of said solenoid coils (19', 34) of said plurality of locks to provide for common control thereof.

15. Electrically controlled, electrically encoded pushbutton combination lock comprising a locking means (4) normally in locked condition;

a plurality of push-button switches (7, 77);

an encoding circuit (13, 53) connected to the push-button switches providing an output permitting unlocking of the locking means if, and only if, the sequence of operation of the plurality of push-button switches conforms to a code contained in the encoding circuit;

a source of operating power (12) for energization of the encoding circuit (13, 53) to permit affecting the encoding circuit on subsequent operation of the push-button switches (7, 77);

and comprising, in accordance with the invention, electromagnetic operating means (19, 19'; 59) controlled by said encoding circuit (13, 53) and permitting operation of said lock to unlocked position upon proper coded operation of said plurality of push-buttons in accordance with the code, said electromagnetic operating means being energizable from energy supplied by said source of operating power (12);

said electromagnetic operating means including a solenoid (19, 19'), an armature in electromagnetic coupled relation with said solenoid;

means (23, 32) interlocking operation of said armature of said solenoid and said locking means (4) to prevent operation of said locking means;

and override means (15, 28, 29, 30; 34-39) engageable with the armature (21) and moving the armature in magnetically attracted position independently of energization of said solenoid.

16. Lock according to claim 15, further including a manual operating knob (8) engageable with said locking means (4), the armature (21) forming a coupling element between said locking means and said knob.

17. Lock according to claim 16, wherein said solenoid (19) is movably mounted on the locking means (4);

said means to prevent operation of the locking means includes a cam disk (23), the armature being engageable with a portion of the cam disk if (a) the solenoid is energized, or (b) said override means is operated.

18. Lock according to claim 15, wherein the locking means (4) is formed with a notch, the armature (21') being engageable in the notch and locking said locking means unless the armature is attracted by the solenoid (19').

19. Lock according to claim 15, wherein said override means includes a rotary element (28) formed with a camming surface (29, 30) selectively engageable with, or releasing said armature from a position simulating magnetic attraction of said armature by the solenoid (19).

20. Lock according to claim 15, wherein said override means comprises a second electromagnetic means (34-37) including a second solenoid (34) and a second armature (36), the second armature being positioned to be in operative engagement with the armature (21') of said operating electromagnetic means (19'-21').

21. Lock according to claim 20, wherein the second electromagnetic means includes a return spring (37) acting on the second armature (36), the second armature (36), when de-energized, being positioned with respect to the armature (21') of said electromagnetic operating means (19'-21') to hold said operating armature (21') in the position which the armature (21') has when its associated solenoid (19') is energized and said operating armature (21'), when energized, then permitting movement of the second armature (36) to its rest, de-energized position, the operating armature (21') permitting selective control of the locking means (4) by a manual operating knob if said armature (21') is (a) attracted due to energization of its solenoid (19') upon proper operation of the encoding push-button switches (7, 77), and (b) (i) if said second magnet is de-energized, said operating armature (21') being retained in the position but (ii) upon energization of the second solenoid (34) of the second electromagnetic means (34-37), said operating armature (21') reverting to its rest position, thus engaging the locking means and preventing movement thereof to unlocked position unless the encoding circuit (13, 53) is properly operated to conform to the code contained therein.

22. Locking system including a plurality of locks, each according to claim 20, further including a central station (C) and common connection means (60, 61, 62) to at least one of said solenoid coils (19', 34) of said plurality of locks to provide for common control thereof.

23. Lock according to claim 16, further including a housing (1), said housing providing a support for said source of operating power (12), the plurality of pushbutton switches (7, 77), the encoding circuit (13, 53), said electromagnetic operating means (19, 19'; 59), and said manual operating means (8) engageable with said locking means.

24. Lock according to claim 1 including a support plate at the side of said push button switches (7, 77);

and emergency electrical connections (10, 11) on said support plate to provide operating power from an external battery power source in case of failure of said source of operating power (12).

25. Lock according to claim 4 wherein said emergency electrical connections comprise polarized button contacts.

26. Lock according to claim 15 including a support plate at the side of said push button switches (7, 77);

and emergency electrical connections (10, 11) on said support plate to provide operating power from an external battery power source in case of failure of said source of operating power (12).

27. Lock according to claim 26 wherein said emergency electrical connections comprise polarized button contacts.

* * * * *